US005472237A

United States Patent [19]

Rajeswaran

[11] Patent Number: 5,472,237

[45] Date of Patent: Dec. 5, 1995

[54] ADJUSTABLE BOOK COVER

[76] Inventor: Vairavapillai A. Rajeswaran, 37 Kilmer Dr., Short Hills, N.J. 07078

[21] Appl. No.: 239,504

[22] Filed: May 9, 1994

[51] Int. Cl.[6] ..... B42D 3/04

[52] U.S. Cl. ..... 281/19.1; 281/34; 281/35

[58] Field of Search ..... 281/15.1, 17, 18, 281/19.1, 19.2, 20, 29, 34, 35, 51

[56] References Cited

U.S. PATENT DOCUMENTS

| | | | |
|---|---|---|---|
| 4,209,187 | 6/1980 | Forrest | 281/19.1 |
| 4,519,630 | 5/1985 | Holmes | 281/19.1 |
| 4,715,619 | 12/1987 | Sloot | 281/19.1 |
| 5,092,630 | 3/1992 | Ostrowski | 281/29 |

*Primary Examiner*—Willmon Fridie

*Attorney, Agent, or Firm*—Arthur I. Degenholtz

[57] ABSTRACT

An adjustable book cover includes a pair of panels which are joined togther to form a flat tubular member of extended length. A relatvely narrow adhesive layer is deposited proximate to each of the longitudinal edges of the panels. A narrow strip of release film is positioned on each of the adhesive layers. The tubular member, which may be stored as a roll or in flat form, is cut to an appropriate length sufficient to cover the width of the book plus an amount sufficient to securely engage the book cover. The tubular member is then folded along its longitudinal edges to accomodate the height of the book. The release layers are removed and the adhesive layer maintains the width of the tubular member. The ends of the book covers are inserted into the ends of the tubular member and the adjustable book cover is mounted on the book in a secure manner.

23 Claims, 6 Drawing Sheets

ADJUSTABLE BOOK COVER

BACKGROUND OF THE INVENTION

The present invention relates generally to book covers and more particularly to an adjustable book cover which can be adjusted to fit and protect a range of books of different sizes.

The prior art related to book covers includes devices which are generally provided in the form of flat sheets. The user is required to fold the ends of the sheet, thereby forming a tube, or a partial tube, having two ends and then insert the covers of a book one at a time into the ends of the tube. In various forms of this type of book cover the surface of the sheet is imprinted with various lines and other indicia to aid the user in folding the sheet into a tube. A disadvantage of this type of book cover is the reliance on friction to maintain the ends of the sheet in the proper folded tubular configuration. Over a period of time, the folded portions of the sheet tend to slide, resulting in a messy appearance and eventual deterioration of the book cover.

OBJECTS AND SUMMARY OF THE INVENTION

It is the object of the present invention to overcome the disadvantages of the prior art by providing an adjustable book cover which can accommodate a range of sizes of books.

Another object of the present invention is to provide an adjustable book cover which can be used to protect both hard cover and soft cover books.

Another object of the present invention is to provide an adjustable book cover which can be easily fastened to the covers of a book.

Another object of the present invention is to provide an adjustable book cover which is capable of maintaining a neat appearance for an extended period of time.

Yet another object of the present invention is to provide an adjustable book cover which can be easily manufactured in volume, resulting in a relatively low unit cost.

In accordance with the present invention, there is provided an adjustable book cover which includes a pair of panels which are joined togther to form a flat tubular member of extended length. The tubular member may be made of paper, plastic film or other sheet material. A relatvely narrow adhesive layer is deposited proximate to each of the longitudinal edges of the panels. A narrow strip of release film is positioned on each of the adhesive layers until the adjustable book cover is used. When the adjustable book cover is used to cover a book, the tubular member, which may be stored as a roll or in flat form, is cut to an appropriate length sufficient to cover the width of the book plus an amount sufficient to securely engage the book cover. The tubular member is then folded along its longitudinal edges to accomodate the height of the book. The release layers are removed and the adhesive layers maintain the width of the tubular member. The ends of the book covers are inserted into the ends of the tubular member and the adjustable book cover is mounted on the book in a secure manner.

In an alternative embodiment of the invention, the ends of the tubular member include tab portions, each of which includes an adhesive layer which is covered by a release layer. The tab portions are used to attach the ends of the adjustable book cover to a book.

In another alternative embodiment of the invention an adhesive layer, which is covered by a release layer, is provided on the inside surface of the first panel of the tubular member. A pair of lines are printed on the outside surface of the second panel opposite the adhesive layer thereby enabling a user to cut away a portion of the second panel to expose the release layer, thereby enabling the user to easily remove a portion of the release layer and attach the ends of the adjustable book cover to a book.

In yet another alternative embodiment of the invention, the flat tubular member is formed of plastic film as a seamless tube. A pair of relatively narrow adhesive layers and a pair of release layers covering the adhesive layers are positioned proximate to the longitudinal edges of the flat tubular member as previously described.

BRIEF DESCRIPTION OF THE DRAWINGS

Other important objects and advantages of the invention will be apparent from the following detailed description of the drawings in which.

DETAILED DESCRIPTION OF THE INVENTION

Figure 1:
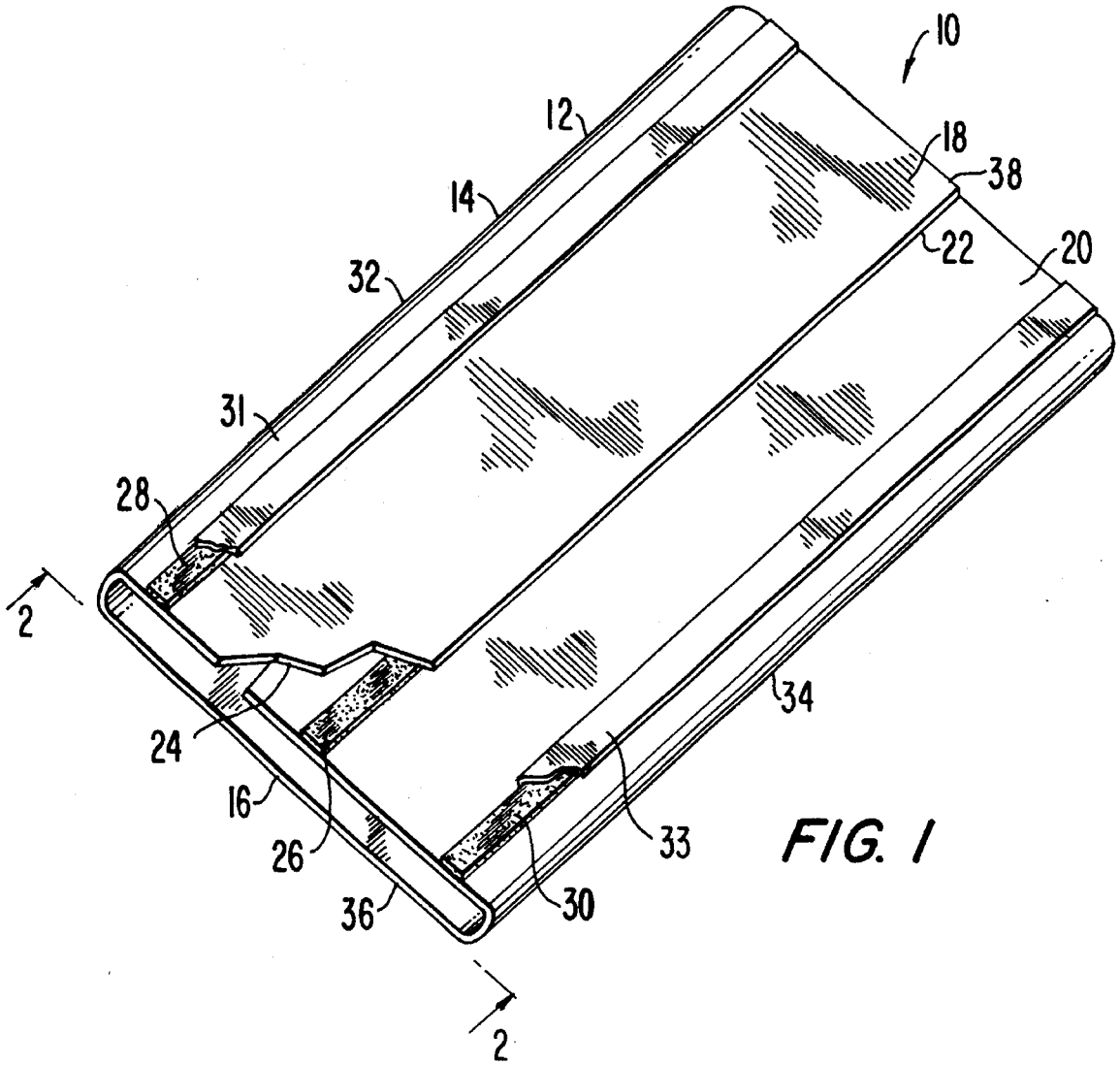
FIG. 1 is an overall perspective view of an adjustable book cover in accordance with the present invention.

With reference to the drawings, there is shown in FIG. 1 an adjustable book cover 10, made in accordance with the present invention which includes a flat tubular member 12 of extended length. The tubular member 12 may be formed of paper, plastic film or other flexible sheet material. In the preferred embodiment, the tubular member 12 is formed of a sheet 14 which has been folded to form a first panel 16 and a pair of panels 18,20 with the longitudinal edge 22 of the panel 18 folded over the panel 20 to form an overlapping portion 24 as is shown on FIG. 1. The two panels 18,20 are joined by an adhesive layer 26, or a crimping process or, in the case of plastic film, a heat sealing process.

Figure 6:
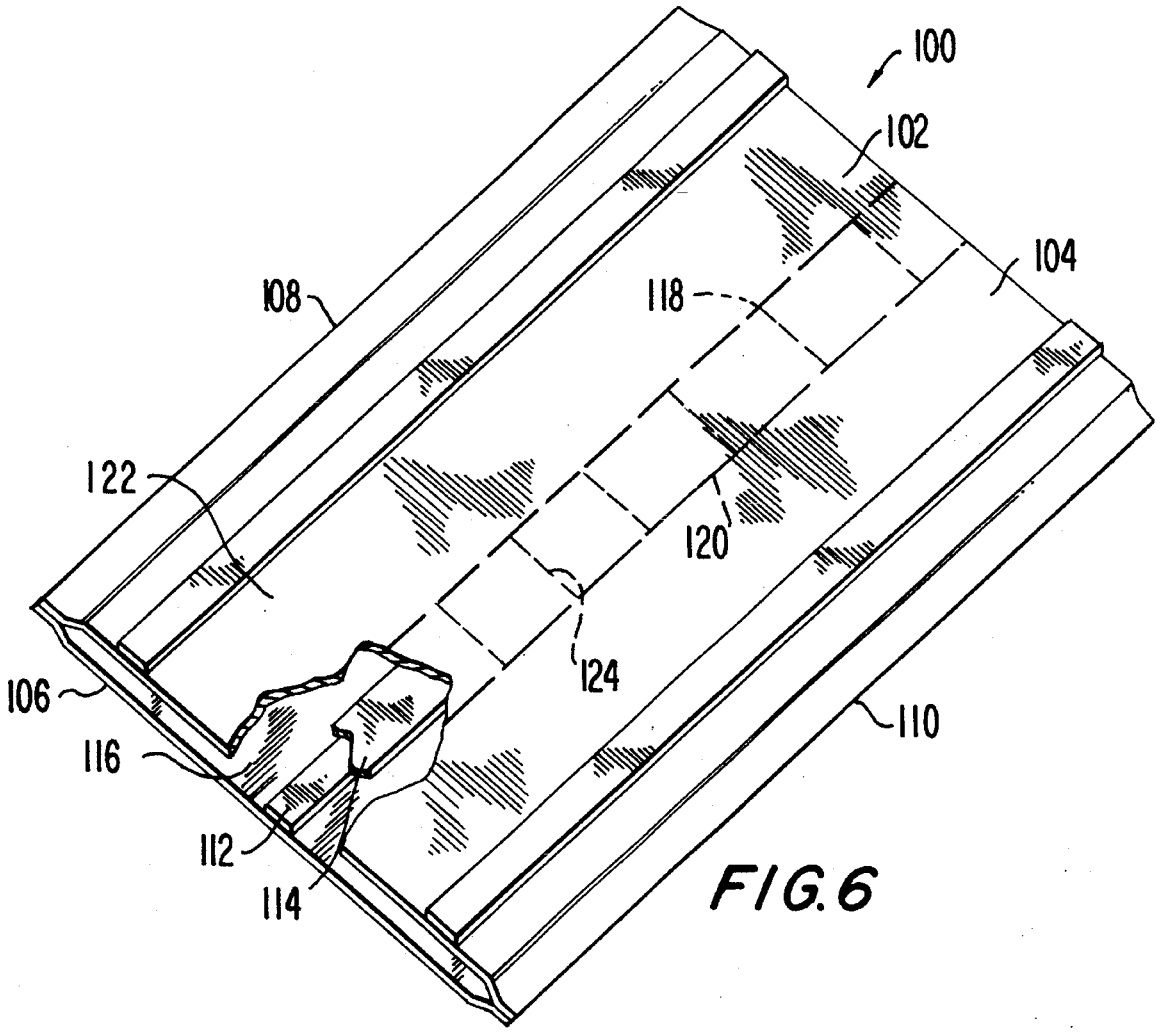
FIG. 6 is an overall perspective view of an alternative embodiment of the invention with portions shown broken away to reveal details of internal construction.

In an alternative embodiment of the invention 100, which is shown in FIG. 6, the tubular member 102 may be formed of two panels 104,106 of plastic film with each panel 104,106 having the same general proportions and with the two panels 104,106 joined together along the longitudinal edges 108,110 by a heat sealing process.

Figure 2:
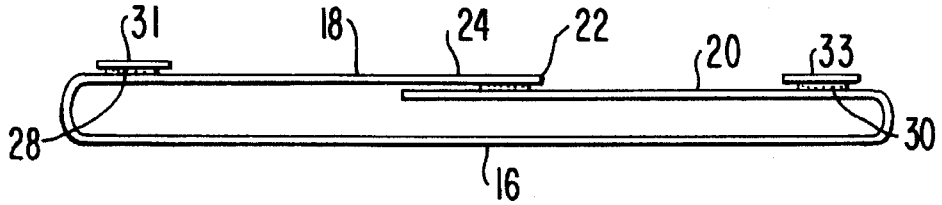
FIG. 2 is an end view taken along the lines 2—2 in FIG. 1.

As is shown in FIG. 1, a relatively narrow adhesive layer 28,30 is deposited proximate to each of the edges 32,34. The adhesive layers 28,30 are each covered by a narrow strip of release film 31, 33 which protects the adhesive layer 28,30 prior to use, as is shown in FIG. 2.

The tubular member 12 may be of extended length and may be supplied to a user in the form of a roll. Portions of the roll may be cut to form book covers in a manner which will be presently described. Alternatively, a plurality of tubular members 12 may be supplied in flat form, each already cut to a preselected length. In the case of a tubular member made of paper, a waterproof coating may be deposited on the paper in order to increase the durability of the adjustable book cover 10.

Figure 3:
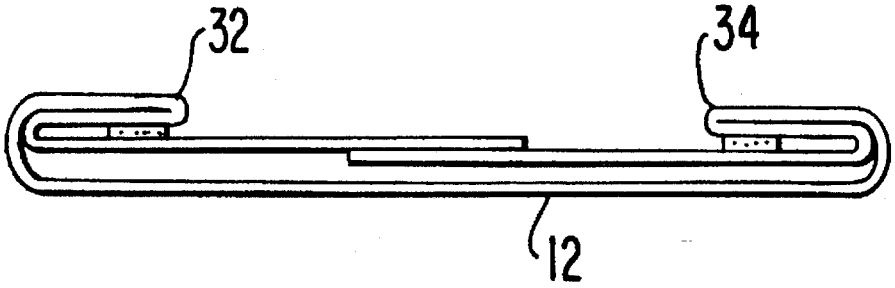
FIG. 3 is an end view similar to FIG. 2 showing the edges of the adjustable book cover folded to accomodate a specific size book.

During use, the ends 36,38 of the tubular member 12 are cut to an appropriate length sufficient to cover the width of the book and to overlap a portion of the cover. The edges 32,34 of the adjustable book cover 10 shown on FIG. 1 are folded, as is shown in FIG. 3, to form a tubular member 12 having a width which approximates the width of the book 40 which is to be protected.

Figure 5:
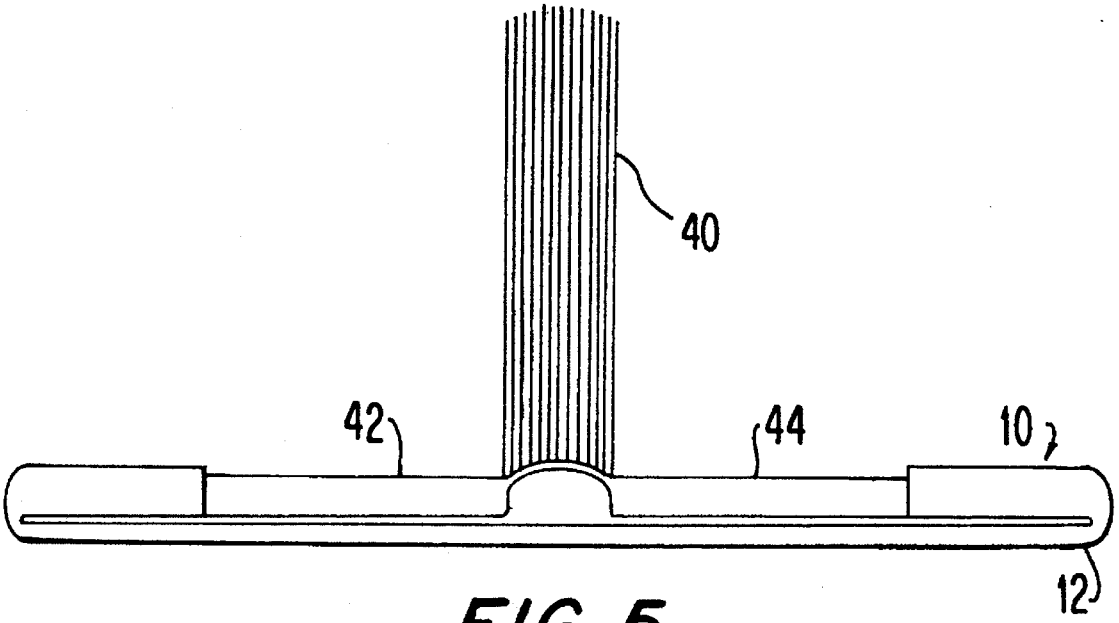
FIG. 5 is a side view showing the adjustable book cover mounted on a book.
Figure 4:
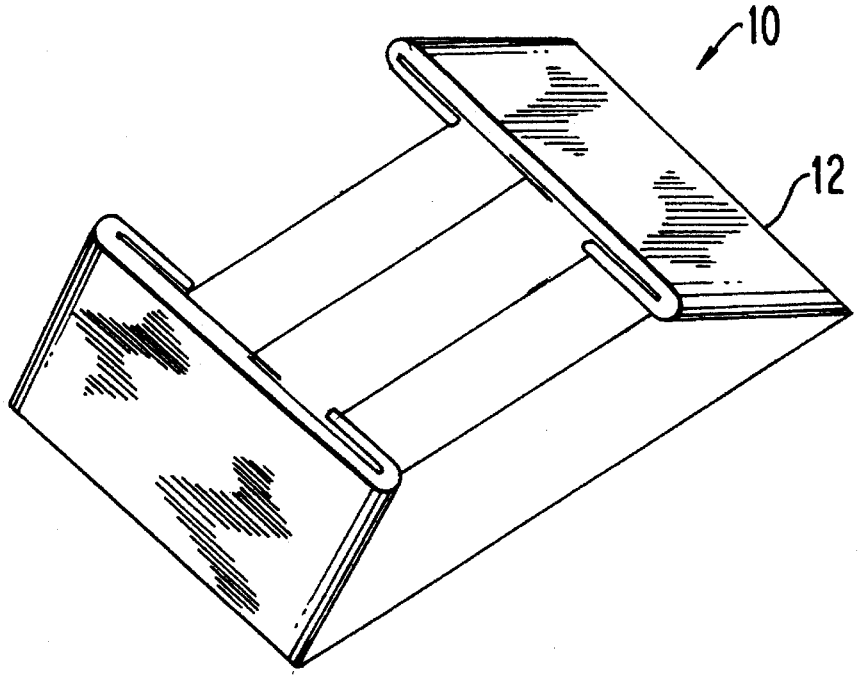
FIG. 4 is a perspective view of the adjustable book cover with ends folded ready to accept a book.

FIGS. 4 and 5 show how the adjustable book cover 10 is mounted on a book 40. The adhesive layers 28,30 maintain the width of the tubular member 12 so that when the covers 42, 44 are inserted into the tubular member 12, the tubular member 12 remains mounted on the book 40 in a secure manner.

Figure 8:
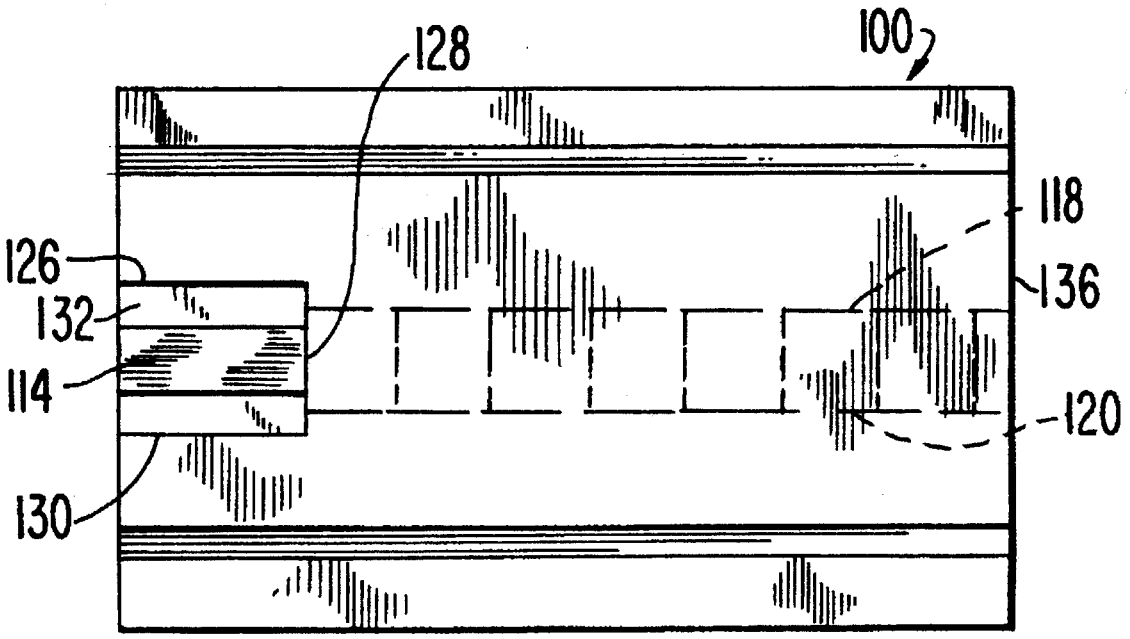
FIG. 8 is a view of the embodiment of FIG. 6, with a portion cut away, in the process of being installed on a book.
Figure 7:
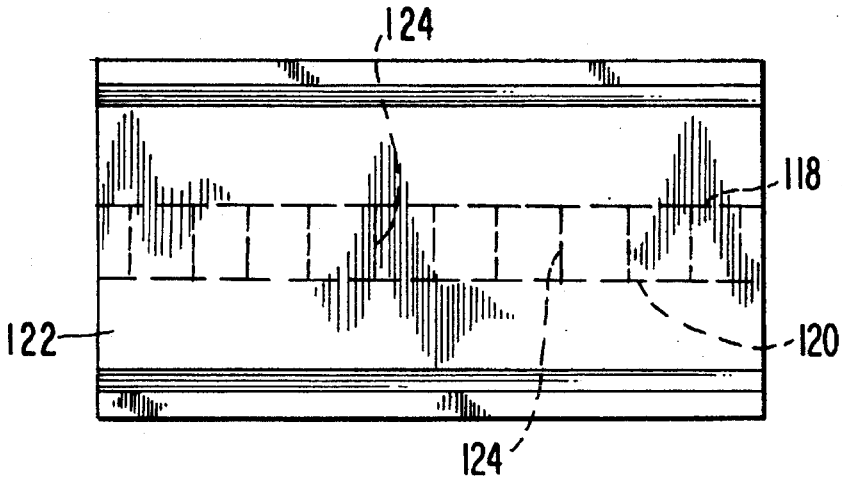
FIG. 7 is a plan view of the embodiment of FIG. 6.

In an alternative embodiment of the invention, shown in FIGS. 6–8, the construction of the adjustable book cover 100 is the same as has been described in connection with FIGS. 1–5 with the exception that a narrow adhesive layer 112, which is covered with a release film 114, is deposited on the inside surface 106 of the first panel 104. A pair of indicia in the form of longitudinal lines which are shown as the broken lines 118,120 in FIGS. 6–8 are printed on the outside surface 122 of the panel 104 opposite the release film 114. The longitudinal lines 118,120 and the shorter transverse lines 124 enable a user to to easily cut away a portion of the panel 104, for example, forming the edges 126, 128,130 as shown in FIG. 8 to expose the release film 114. Removing a portion of the release film 114 exposes the adhesive layer 112 and enables a user to adhere the end portions 132,136 of the adjustable book cover 100 to the inside of the covers of the book 40.

Figure 9:
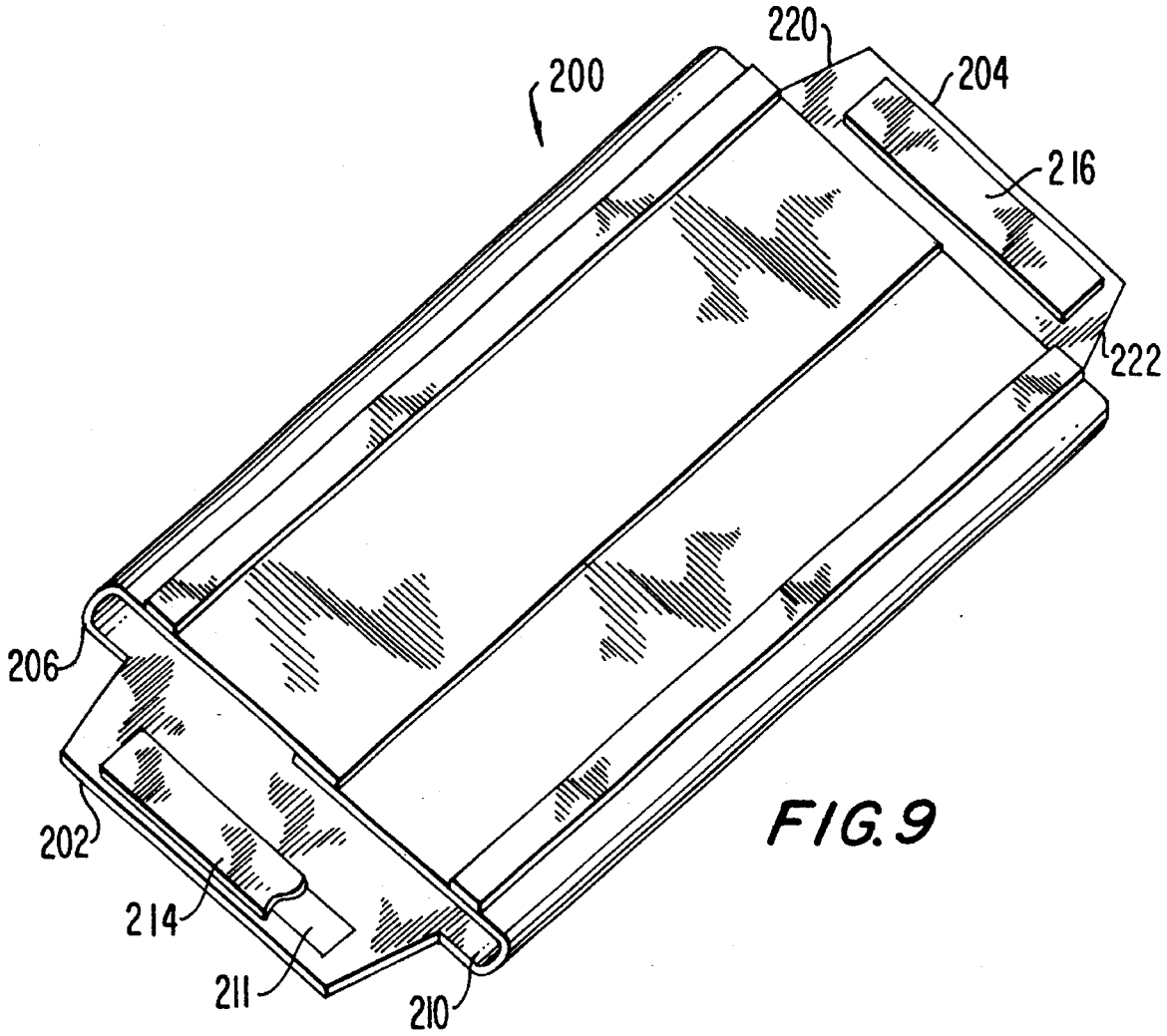
FIG. 9 is an overall perspective view of another embodiment of the invention.
Figure 10:
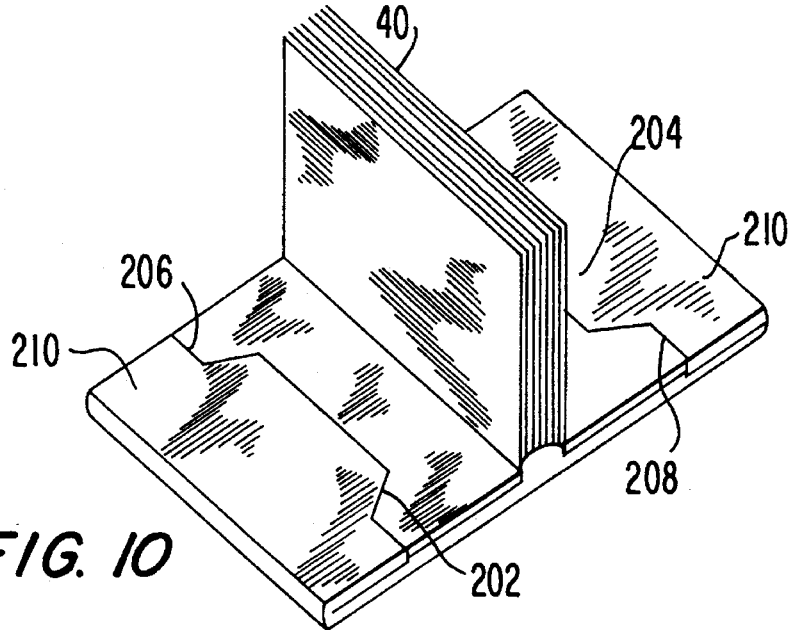
FIG. 10 is a perspective view of the embodiment of FIG. 10 in the process of covering a book.
Figure 11:
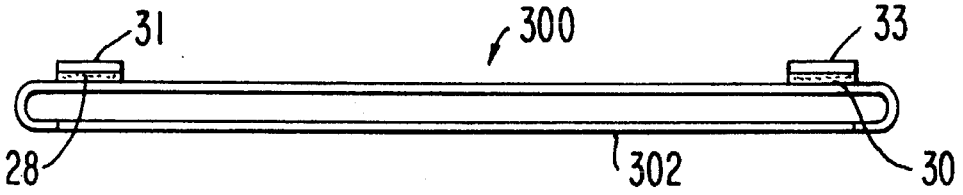
FIG. 11 is an end view of another alternative embodiment of the invention, similar to FIG. 2, showing an embodiment in which the tubular member is formed as a seamless tube.

In another alternative embodiment of the invention, shown in FIGS. 9 and 10, the construction of the adjustable book cover 200 is the same as has been described in connection with FIGS. 1–5, with the addition of the tab portions 202,204, which are formed on the ends 206,208 of the first panel 210. The edges 220,222 of the tab portions 202,204 converge toward each other as is shown in FIG. 9. Each of the tab portions 202,204 includes an adhesive layer 211 which is covered with a release layer 214,216. The tab portions 202,204 are used to attach the adjustable book cover 200 to a book 40 as is shown in FIG. 10.

Figure 12:
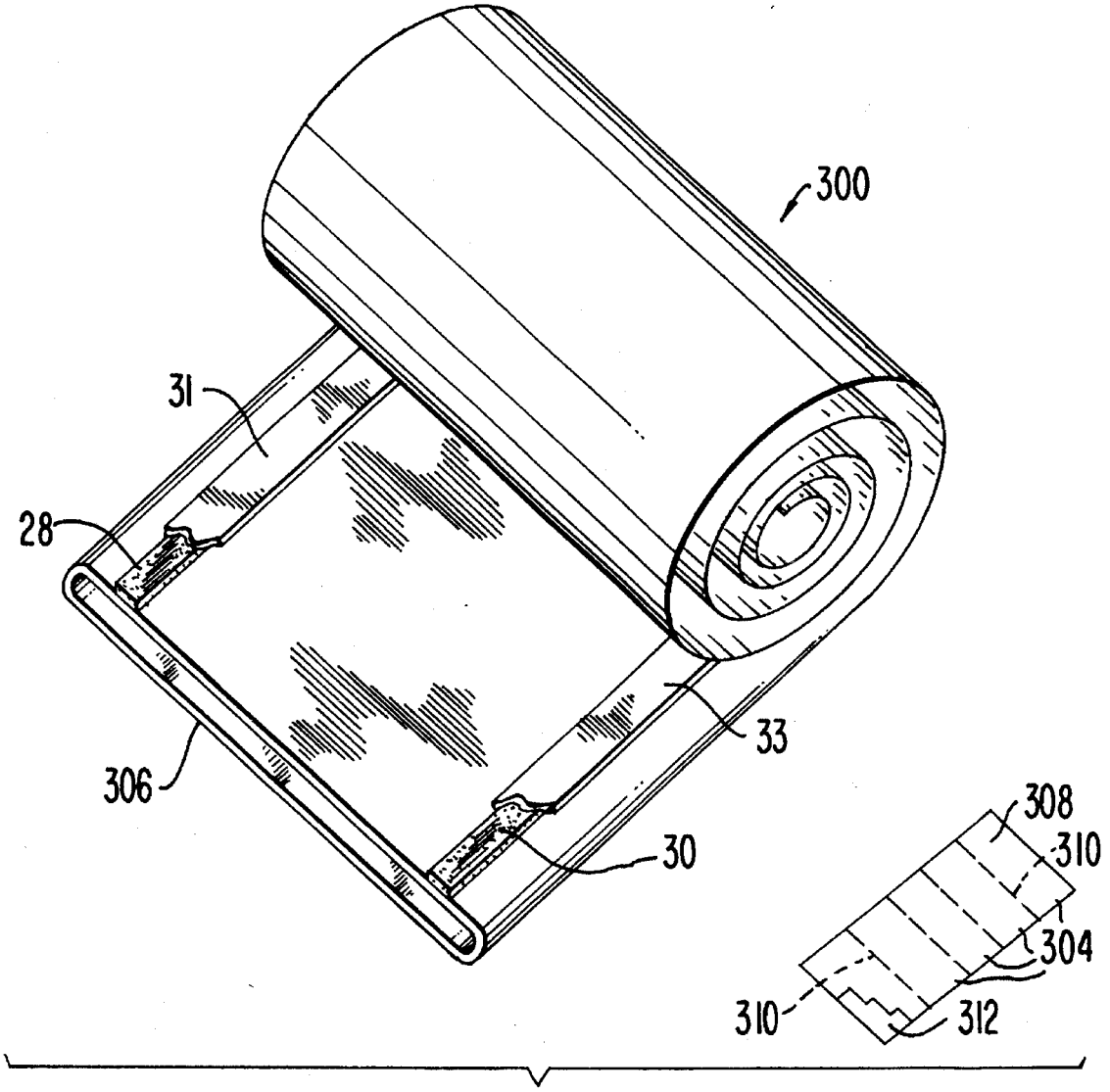
FIG. 12 shows the embodiment of FIG. 11 stored in the form of a roll.

In another embodiment of the invention 300, the tubular member 302 is formed of plastic film as a seamless tube. Adhesive layers 28, 30 and strips of release film 31,33 are identical to the adhesive layers 28,30 and strips of release film 31, 33 which have been described in connection with FIGS. 1 and 2. The tubular member is of elongated length sufficient to cover one, two or a larger number of books and the tubular member may be stored in the form of a roll as shown in FIG. 12 for purposes of covenience of storage and shipment prior to sale and use. In the embodiment 300, a plurality of adhesive tabs 304 are provided as shown in FIG. 12 for the purpose of attachment of the ends of the tubular member such as the end 306 to the inside of the cover of a book in a manner similar to that which has been shown in FIG. 10. The tabs may be provided either as individual adhesive tabs 304 or as a strip of adhesive tabs 308 separated by perforations 310 on a release layer 312 as shown in FIG. 12.

The foregoing specific embodiments of the present invention as set forth in the specification are for illustrative purposes only. Various changes and modifications may be made within the spirit and scope of this invention.

What is claimed is:

1. An adjustable book cover comprising:

a first rectangular panel, a second rectangular panel, with said first and said second panels each having a first and a second longitudinal edge, joining means joining said longitudinal edges of said first and said second rectangular panels to form a tubular member, an elongated adhesive layer disposed proximate to said first longitudinal edge on the outer surface of said tubular member, and an elongated release layer disposed covering said elongated adhesive layer.

2. An adjustable book cover according to claim 1 in which said first and said second rectangular panels are made of paper.

3. An adjustable book cover according to claim 1 in which said first and said second rectangular panels are made of plastic film.

4. An adjustable book cover according to claim 1 in which said joining means comprises an adhesive layer disposed between said longitudinal edges of said first and said second panels.

5. An adjustable book cover according to claim 1 in which said joining means comprises heat sealing means.

6. An adjustable book cover according to claim 1 further comprising:

a second elongated adhesive layer disposed proximate to said second longitudinal edge, and a second elongated release layer disposed covering said second elongated adhesive layer.

7. An adjustable book cover comprising:

a flat rectangular member having a pair of longitudinal edges and having a first longitudinal fold generally parallel to a first of said longitudinal edges and thereby forming a first rectangular panel and a rectangular second panel and a second longitudinal fold generally parallel to a second of said longitudinal edges and thereby forming a third rectangular panel, with said second rectangular panel partially overlaying said third rectangular panel, connection means connecting said second and said third panels, an elongated adhesive layer disposed on said second panel proximate to said first longitudinal fold, and an elongated release layer disposed covering said elongated adhesive layer.

8. An adjustable book cover according to claim 7 in which said connection means comprises an adhesive layer.

9. An adjustable book cover according to claim 7 in which said connection means comprises a heat seal.

10. An adjustable book cover according claim 7 in which a second elongated adhesive layer is disposed on said third panel proximate to said second longitudinal fold, and a second elongated release layer disposed covering said second elongated adhesive layer.

11. An adjustable book cover according to claim 7 in which said connection means comprises crimping means.

12. An adjustable book cover according to claim 7 further comprising a pair of lateral edges on said first panel, a pair of tab portions projecting from each of said lateral edges of said first panel, a pair of adhesive layers disposed, one each, on said tab portions, and a pair of release layers disposed, one each, covering said adhesive layers on said tab portions.

13. An adjustable book cover according to claim 1 further comprising a pair of lateral edges on said first panel, a pair of tab portions projecting from each of said lateral edges of said first panel a pair of adhesive layers disposed, one each, on said tab portions, and a pair of release layers disposed, one each, covering said adhesive layers on said tab portions.

14. An adjustable book cover according to claim 7 with said first panel further comprising an inner surface and an outer surface, a third elongated adhesive layer deposited on said inner surface of said first panel, and a third release layer disposed covering said elongated adhesive layer.

15. An adjustable book cover according to claim 1 with said first panel further comprising an inner surface and an outer surface, a third elongated adhesive layer deposited on said inner surface of said first panel, and a third release layer disposed covering said elongated adhesive layer.

16. An adjustable book cover according to claim 15 further comprising at least one indicia printed on said second panel generally opposite said third release layer for the purpose of locating said third adhesive layer.

17. An adjustable book cover according to claim 14 further comprising at least one indicia printed on said second panel generally opposite said third release layer for the purpose of locating said third adhesive layer.

18. An adjustable book cover according to claim 1 in which said first and said second panels are of extended length and in which said first and said second panels are rolled to form a cylindrical roll having an axis transverse to said elongated first and said second panels.

19. An adjustable book cover according to claim 7 in which said rectangular member is of extended length and with said rectangular member rolled to form a cylindrical roll having an axis transverse to said rectangular member.

20. An adjustable book cover according to claim 2 further comprising a waterproof coating deposited on said first and said second rectangular panels.

21. An adjustable book cover comprising;

a flattened seamless tubular member having a first longitudinal edge and a second longitudinal edge, an elongated adhesive layer disposed proximate to said first longitudinal edge on the outer surface of said tubular member, and an elongated release layer disposed covering said elongated adhesive layer.

22. An adustable book cover according to claim 21 in which said flattened seamless tubular member is made of plastic film.

23. An adjustable book cover according to claim 21 further comprising a plurality of adhesive tabs.

* * * * *